United States Patent [19]

Bertschmann et al.

[11] 4,050,207

[45] * Sept. 27, 1977

[54] EXPANSION GAP SEALING DEVICE

[75] Inventors: Silvio Bertschmann, Meggen, Switzerland; Waldemar Koester, Forsbach, Germany; Reinhold Huber, Rorbas, Switzerland

[73] Assignee: Firma Friedrich Maurer Soehne, Munich, Germany

[ * ] Notice: The portion of the term of this patent subsequent to Sept. 9, 1992, has been disclaimed.

[21] Appl. No.: 543,779

[22] Filed: Jan. 24, 1975

Related U.S. Application Data

[63] Continuation of Ser. No. 308,452, Nov. 21, 1972, Pat. No. 3,904,302.

[30] Foreign Application Priority Data

Apr. 10, 1972 Germany ..... 2217151

[51] Int. Cl.[2] ..... E04B 1/68

[52] U.S. Cl. ..... 52/396; 52/573; 404/68

[58] Field of Search ..... 52/396, 573; 404/68; 14/16 J

[56] References Cited

U.S. PATENT DOCUMENTS

| | | | |
|---|---|---|---|
| 3,797,188 | 3/1974 | Mansfeld | 52/396 |
| 3,797,952 | 3/1974 | Pommerening et al. | 52/396 X |
| 3,824,025 | 7/1974 | Beutler | 404/68 X |
| 3,904,302 | 9/1975 | Bertschmann | 52/396 X |

*Primary Examiner*—Price C. Faw, Jr.
*Assistant Examiner*—Carl D. Friedman
*Attorney, Agent, or Firm*—W. G. Fasse; W. W. Roberts

[57] ABSTRACT

The present expansion gap sealing device has a plurality of strips and elastomeric bodies between adjacent strips which extend longitudinally through the gap. The strips are supported by legs extending downwardly into the gap. Upper ends of the legs are connected to the strips. Lower ends of the strips are interconnected with each other in pairs whereby adjacent legs form a pair and an elastically yielding structure. The lower leg ends may be interconnected by bars and the entire supporting structure may be guided by movably supported guide means in the gap.

31 Claims, 30 Drawing Figures

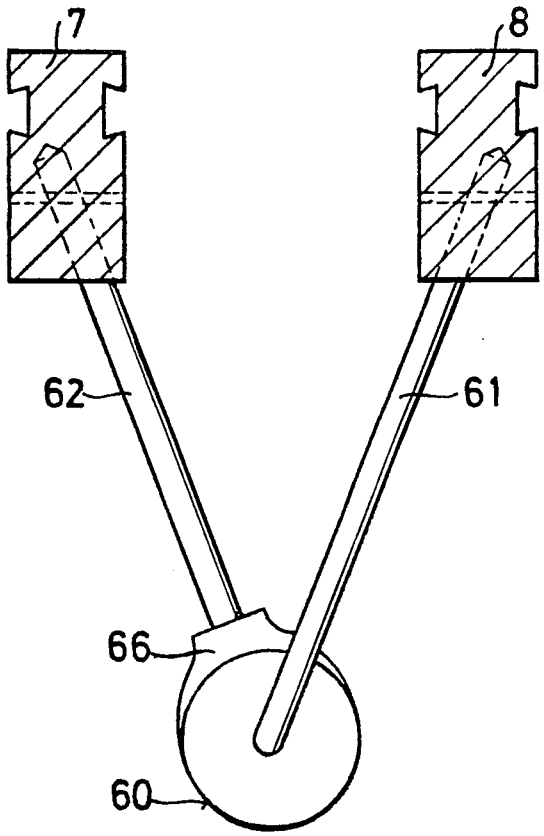
Fig. 15
Fig. 17
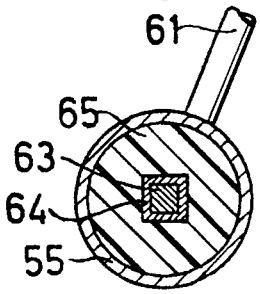
Fig. 18
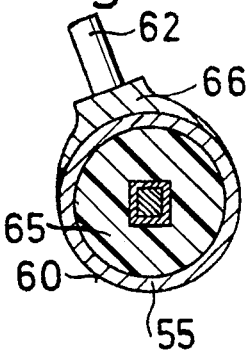
Fig. 16
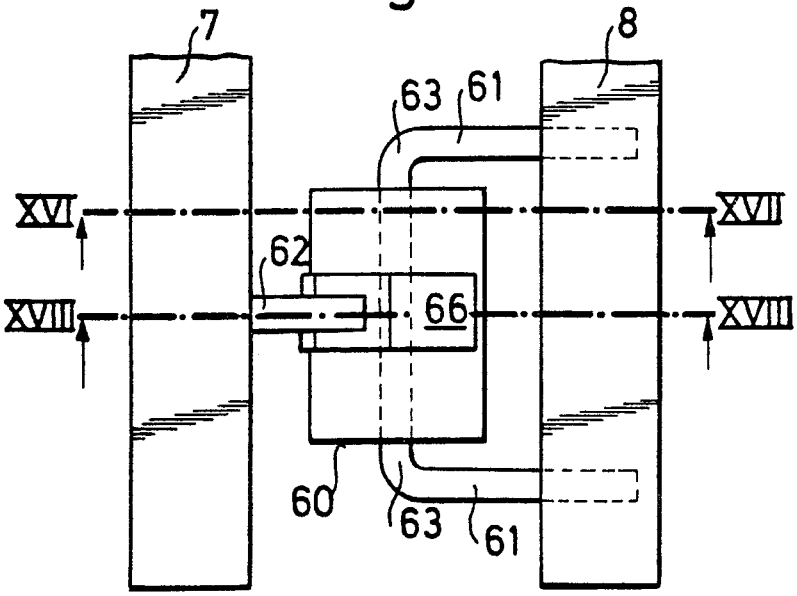

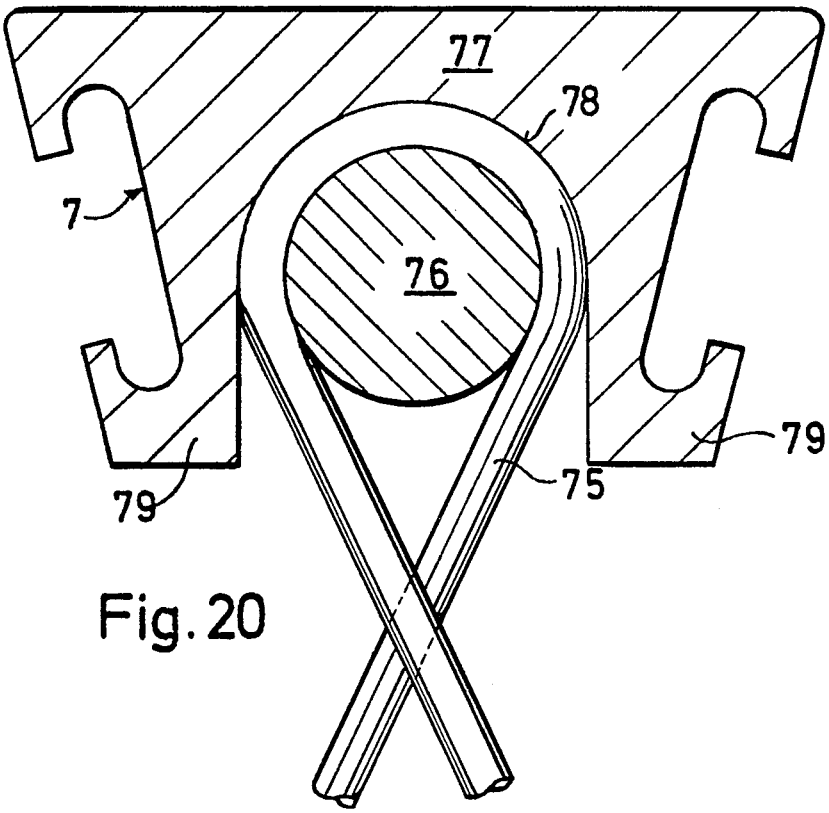
Fig. 20
Fig. 21
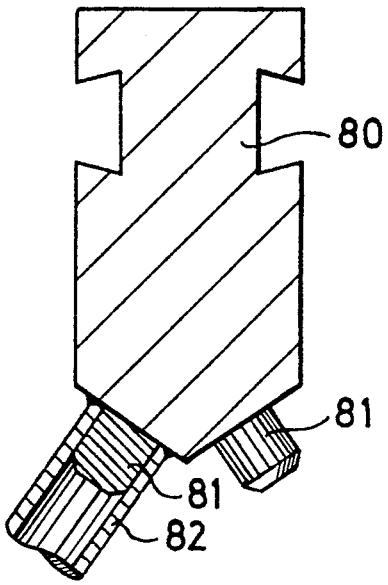
Fig. 22
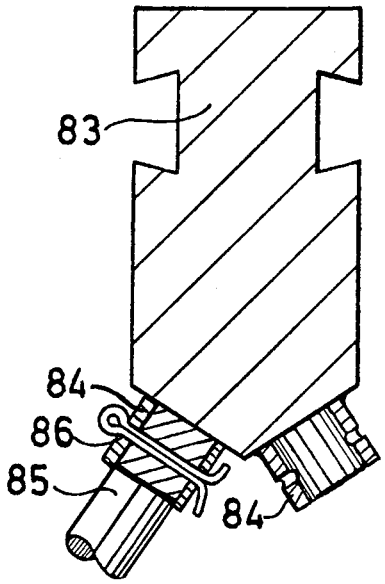

EXPANSION GAP SEALING DEVICE

BACKGROUND OF THE INVENTION

The present application is a continuation application and an application under Rule 45 of copending application Ser. No. 308,452 filed Nov. 21, 1972 now U.S. Pat. No. 3,904,302 granted Sept. 9, 1975.

The invention relates to expansion gap sealing devices for bridging expansion gaps in bridges, roadways or the like wherein so called gap strips form the traffic supporting roadway surface. Between adjacent strips there are inserted elastic expansion members extending with the strips longitudinally and in parallel to each other through the gap. The gap strips include edge plates connected to the edges of the gap.

In a known device of this kind as described in German Pat. Publication No. 1,534,229 the strips are supported on a structure of connecting rods jointed at both sides to the edge of the gap. Each strip is connected at its underside to a number of the rods. Under traffic load conditions the strips press on the joints whereby the load is distributed over all the pivoted rods and is transmitted to the edges of the gap. As the structure serving as a support for the plate is arranged below the plates, the spaces between the plates can be employed for positioning said expansion members which act as sealing bodies so as to produce a water-tight construction.

The known device requires a high degree of accuracy in manufacture if a uniform distribution of forces in the connecting rods is to be achieved. The pivots are subject to wear and tear and tend to produce rattling noises. Forces acting transverse to the direction of traffic movement cannot be absorbed by the known device, yet such forces do arise and in practice they cannot be avoided whereby overloading of the joints cannot be prevented and the useful life of the assembly is thereby shortened.

Another known device disclosed in German Pat. No. 1,255,127 is of a grid-like construction. In one embodiment of this construction the grid bars which extend transversely to the direction of traffic movement form the road surface in the region of the gap. These grid bars are rigidly connected to the grid bars that bridge the gap. The last mentioned bars extend upwardly and are curved elastically yielding supporting rods.

This known device avoids pivot joints subject to wear and tear. However, it has the drawback that one cannot make it water-tight. The small gaps between the grid bars which are subject to two-dimensional changes of shape at every movement of the expansion gap, cannot be sealed effectively.

A further drawback of the known device is seen in that the desired elasticity of the grid can only be attained when the sealing device bridges relatively narrow gaps because only then may the supporting bars to made sufficiently thin to be easily deformable. Known sealing devices of the just described type require stiff carrier bars when they are to bridge wide expansion gaps, whereby the known device only has a small elasticity or deformability.

A further drawback of the known device is seen in that the straight supporting bars which extend across the line of traffic flow cannot be arranged with any desired small spacing between them because sufficient space must be provided between the straight bars for the wavy supporting bars. This requirement produces problems both in the employment of the known device in very narrow expansion gaps and also in wide expansion gaps with stiff supporting bars of substantial dimensions, which only have sufficient deformability when they are longer than a predetermined length, and when there is a predetermined spacing between the bars which extend transverse to the direction of traffic flow.

OBJECTS OF THE INVENTION

In view of the above, it is the aim of the invention to achieve the following objects singly or in combination;

- to provide a device of the kind mentioned above, which can be made water-tight without any difficulties and which at the same time operates substantially without wear;
- to provide a device which may be effectively sealed regardless of the width of the gap so that it is insensitive to dirt; and
- to provide a support for the sealing means proper which spans the gap with sufficient strength and elasticity for a wide range of gap widths.

SUMMARY OF THE INVENTION

According to the invention each support comprises legs or sections extending perpendicular or inclined to the roadway surface, wherein the legs are connected together through their upper and lower ends, whereby the supporting structure is elastically deformable in itself and/or due to the interconnections.

By the term supports in the sense of the invention we mean quite generally an assembly of individual sections put together, which sections are elastically deformable, i.e., are movable against resilient opposition. The sections or legs may have the form of plates or rods.

As the sections extend substantially vertically or inclined to the roadway surface, their vertical length is only limited by the depth of the gap and therefore the legs may be made sufficiently elastic for all gap widths and at the same time of sufficient strength. The space available below the gap strips may be fully employed. Moreover, the construction according to the invention avoids sealing problems because the spaces between the strips may be sealed in the usual manner by elastically yielding sealing bodies.

Another advantage of the invention is seen in that one or more superimposed levels of leg sections may be employed. For example, each level may comprise a row of rods arranged in a V-formation, connected either directly or through intermediate members to the rods of further levels of legs. The legs may be interconnected directly, for example, by weldments to the strips whereby the weldments would form first connecting means, and whereby second connecting means could, for example, be formed by the portion of a U-or V-shape which interconnects the legs forming a pair.

Convenient manufacture may also be achieved where the second connecting means for the lower ends of the legs comprise connecting members, for example, bars with holes or grooves therein into which the ends of the legs are inserted.

BRIEF FIGURE DESCRIPTION

In order that the invention may be more clearly understood, it will now be described, by way of example, with reference to the accompanying drawings, wherein.

Figure 1:
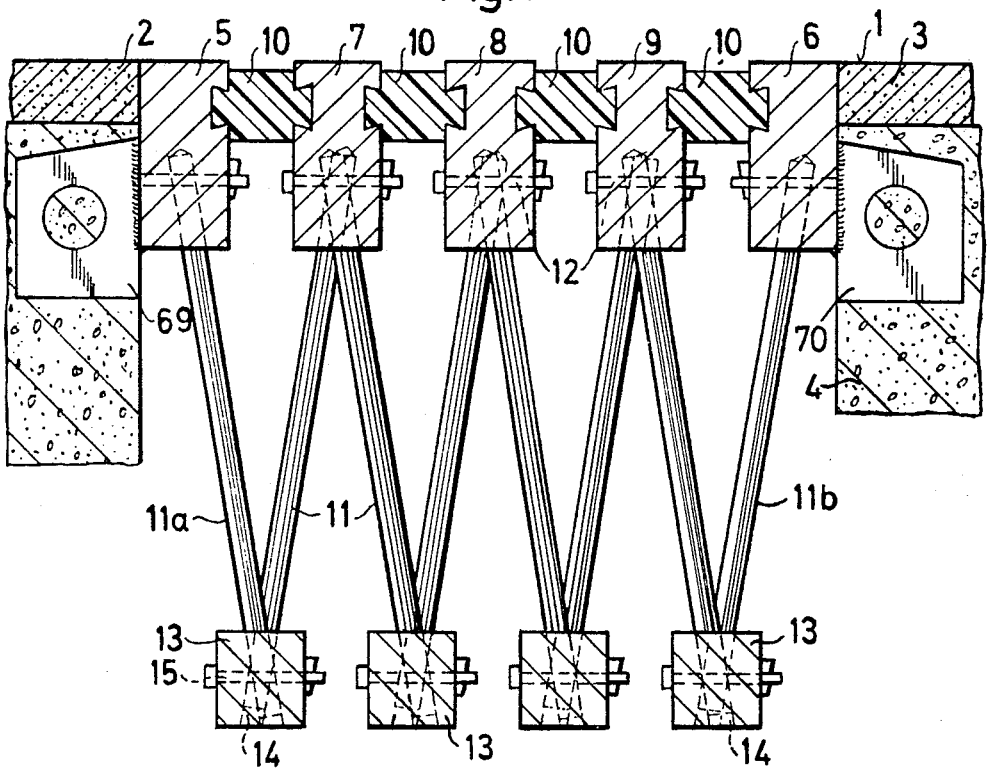
FIG. 1 is a section through one embodiment of the sealing device according to the invention, taken in a plane transversely through the gap.
Figure 7:
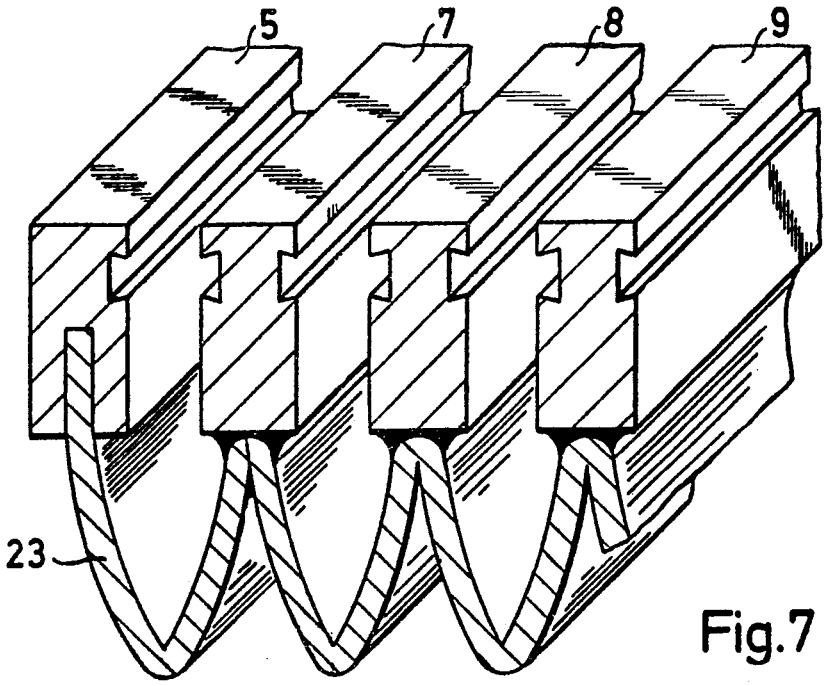
FIG. 7 shows a perspective view of a portion of a device with a support made of undulating sheet metal.
Figure 9:
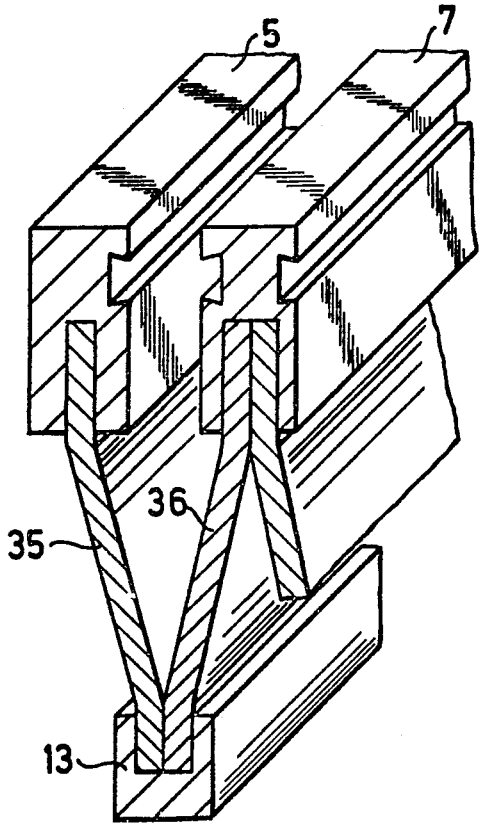
Figure 10:
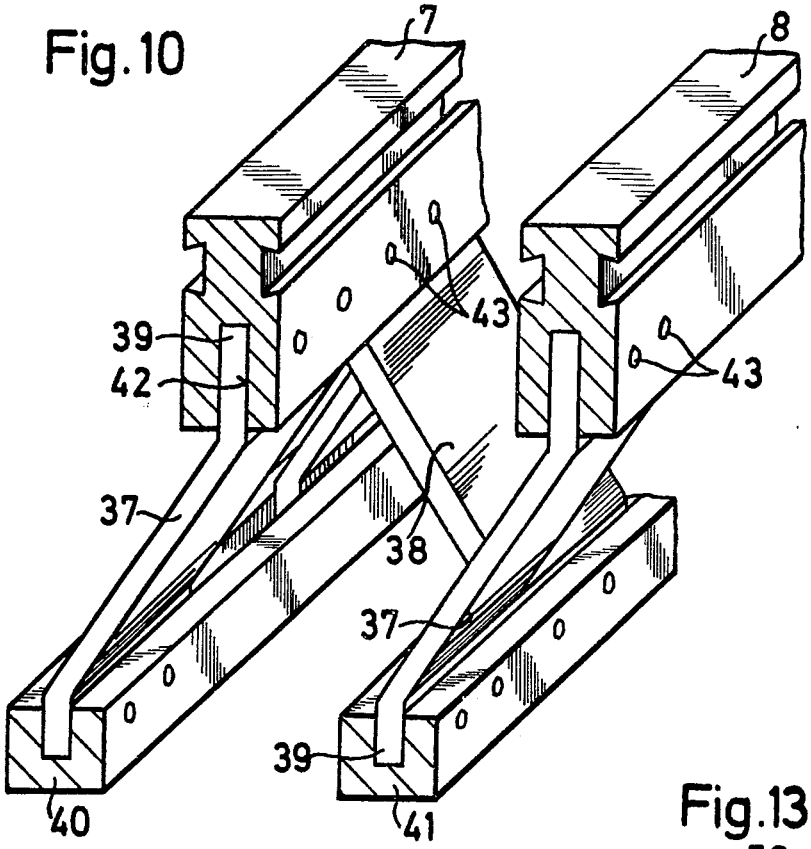
Figure 12:
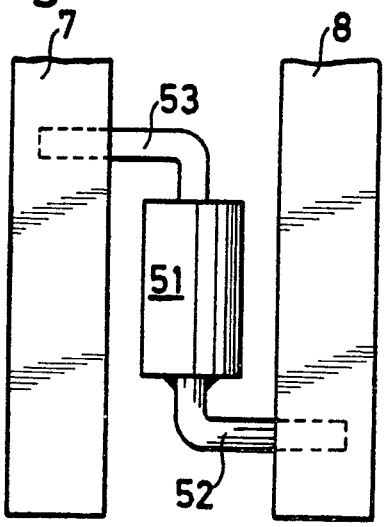
Figure 13:
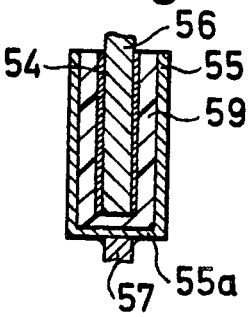
Figure 14:
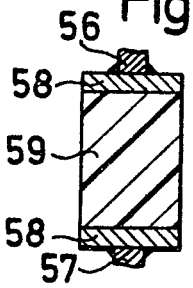
Figure 11:
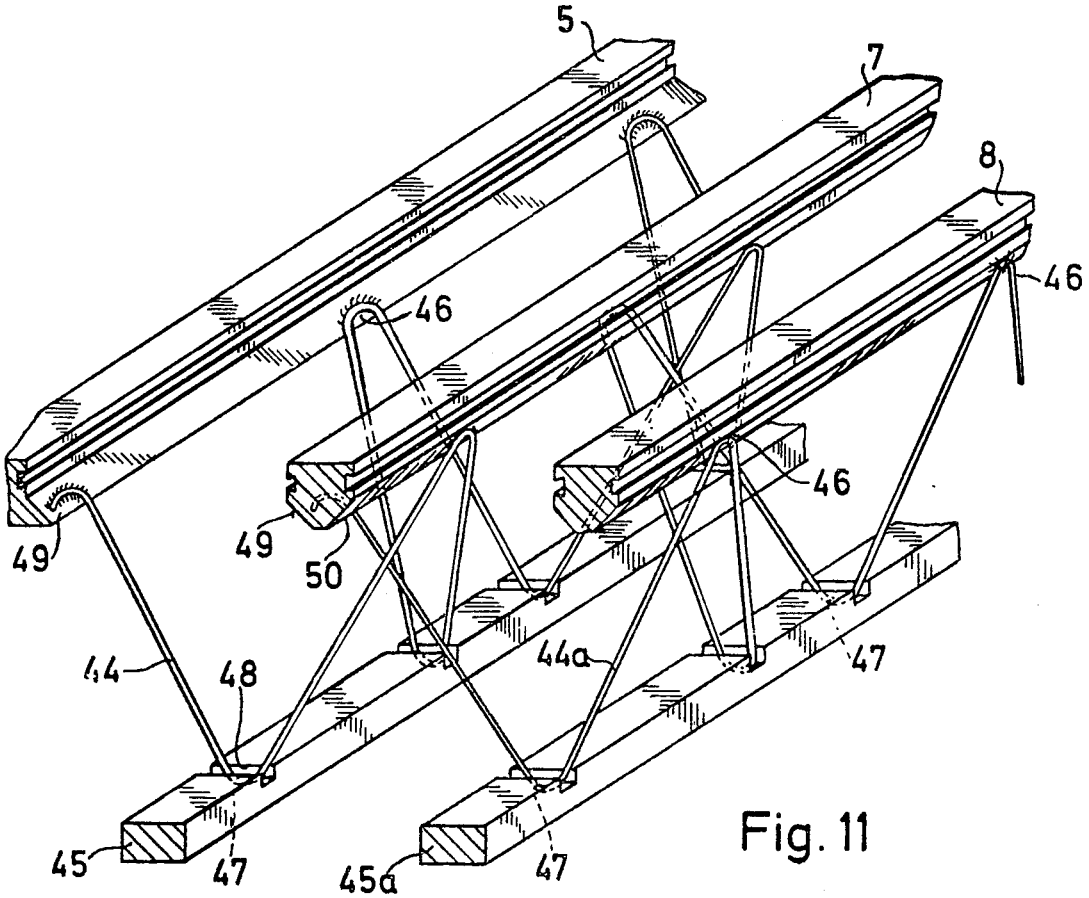
Figure 19:
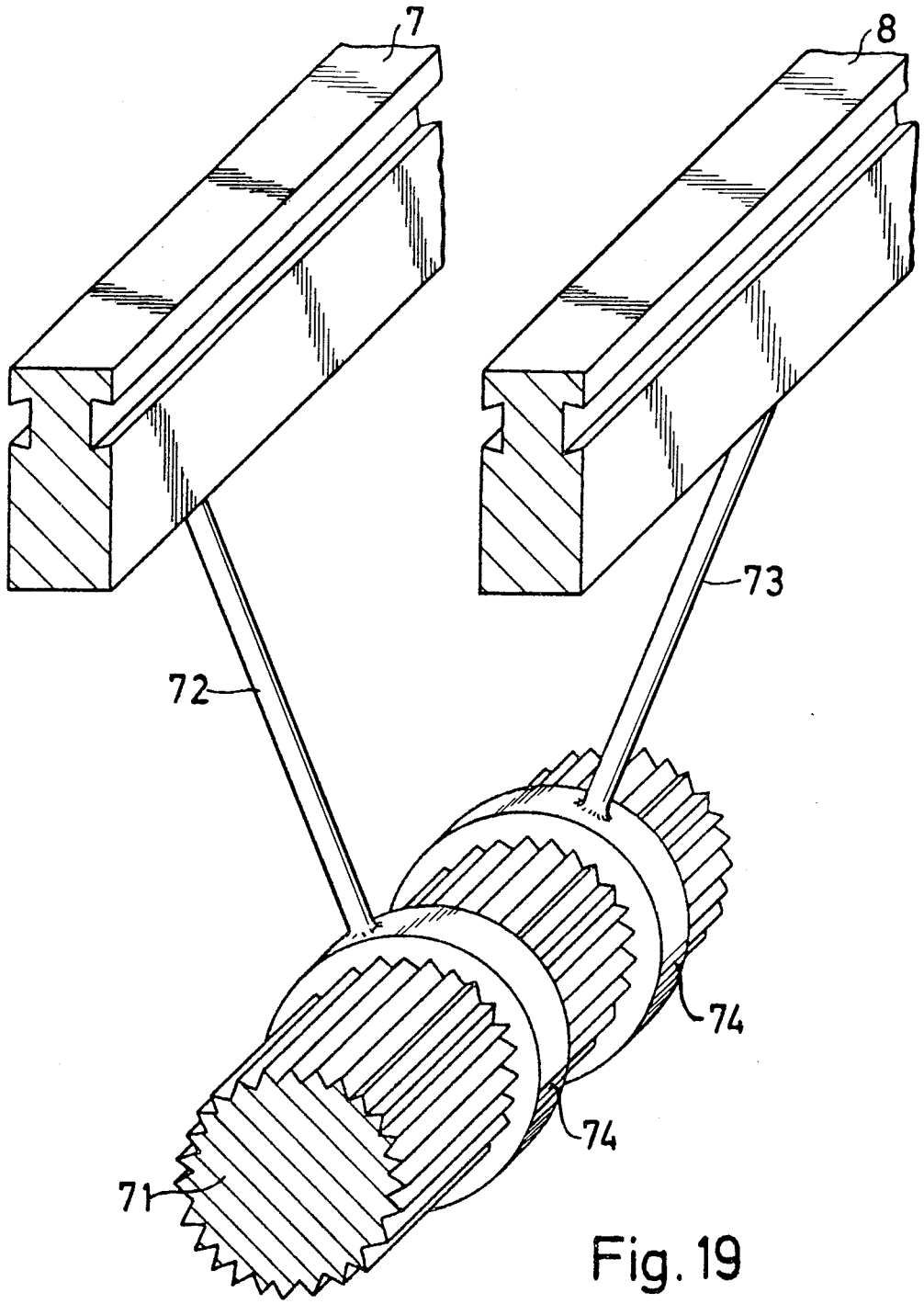
Figure 28:
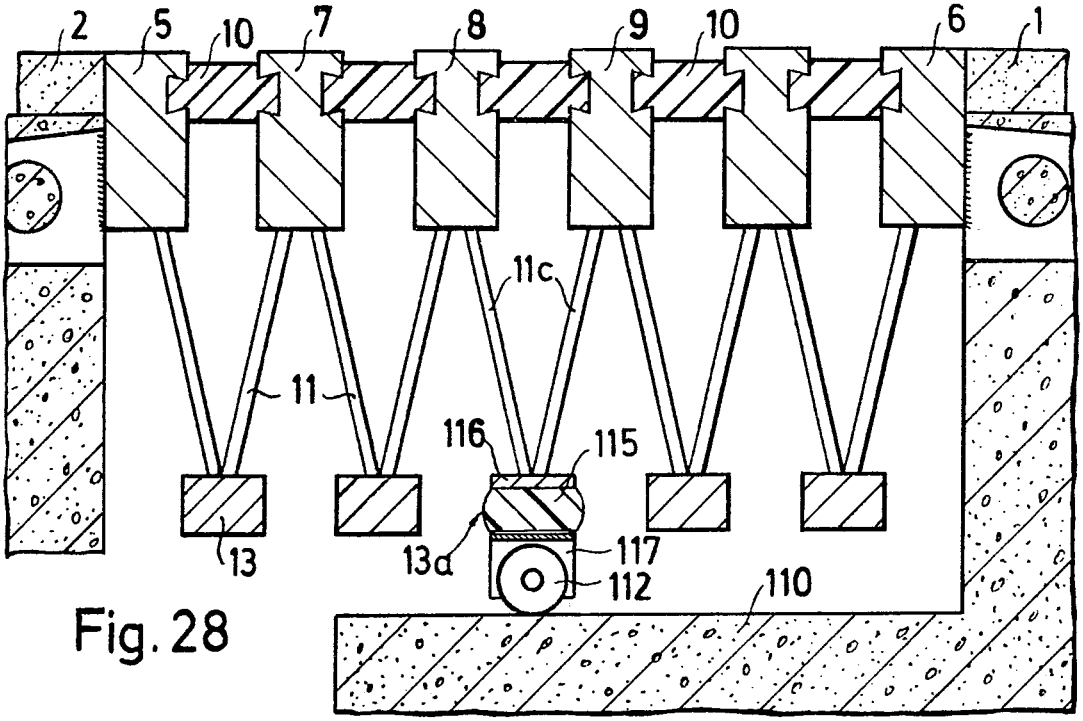
Figure 29:
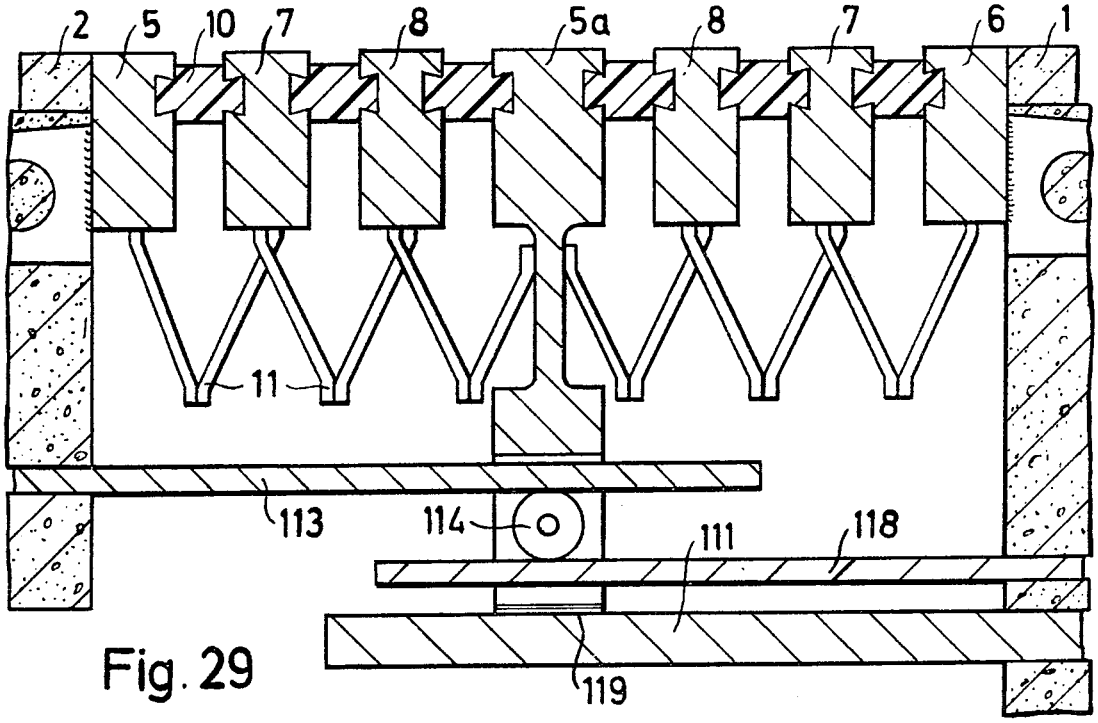
Figure 30:
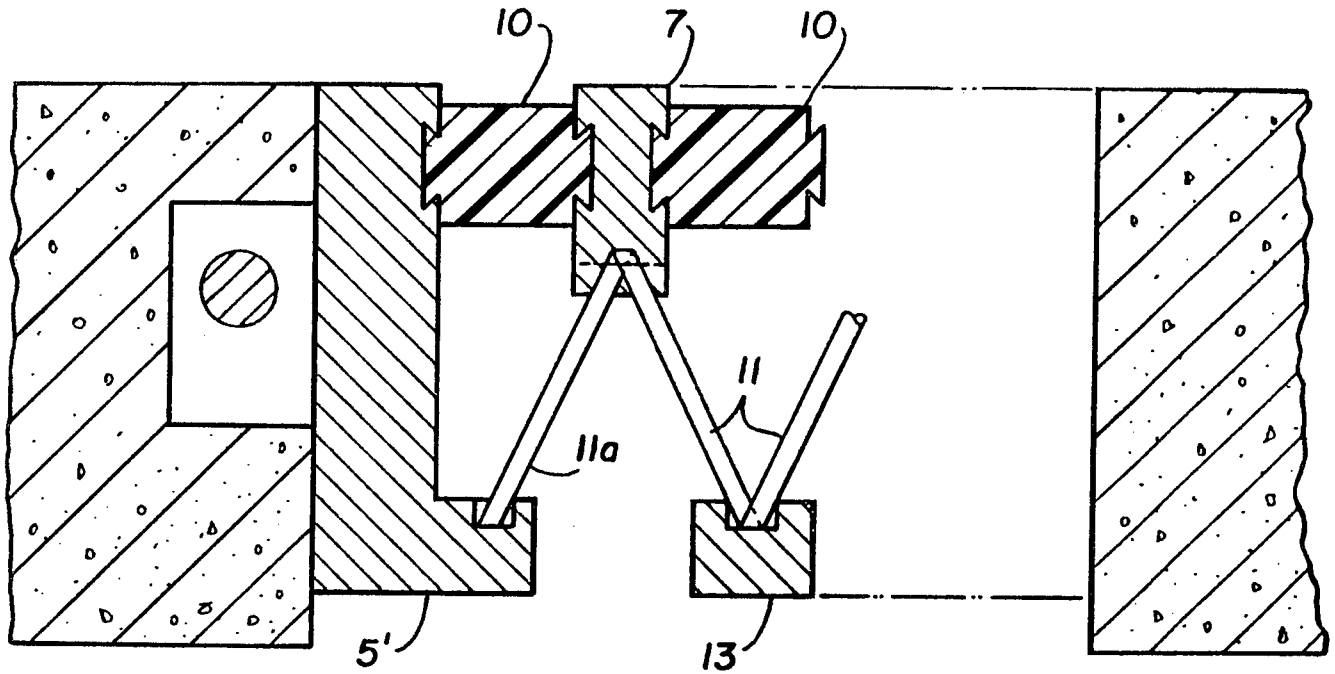

FIG. 9 on the same sheet of drawings as FIG. 7 shows in perspective a portion of a device with a support made of said Y-shaped configuration;

FIG. 10 is a perspective illustration of a portion of a device with a support made of plates arranged in a row one adjacent to the next in the direction of the length of the gap;

FIG. 11 is a perspective view of a portion of a device with a support made out of rod means bent in three dimensions;

FIG. 12 on the same sheet as FIG. 10 is a plan view of a torsion member;

FIG. 13 on the same sheet as FIGS. 10 and 12 shows a section through an embodiment of a torsion member;

FIG. 14 on the same sheet as FIGS. 10, 12 and 13 shows another embodiment of a torsion member in section;

FIG. 15 illustrates yet another torsion member;

FIG. 16 shows a plan view of the torsion member of FIG. 15;

FIG. 17 is a section along the line I-I in FIG. 16;

FIG. 18 is a section along the line II-II in FIG. 16;

FIG. 19 shows a torsion member in the form of a splined shaft;

FIGS. 20 to 27 show various ways of attaching a supporting rod to a gap strip;

FIGS. 28 and 29 illustrate further embodiments of the device according to the invention, particularly suitable for large gap widths; and FIG. 30 shows an embodiment similar to that of FIG. 1 except that in FIG. 30 the lower end of the first leg is connected to the edge of the gap.

DETAILED DESCRIPTION OF EXAMPLE EMBODIMENTS

FIG. 1 shows the gap to be bridged in cross section. The gap is defined by the two edges 1 and 2, for example of a roadway, having a surface layer 3 and a roadway sub-structure 4. The gap is bridged by gap strips including two edge plates 5 and 6 secured to the edges of the gap as by welding and a plurality of strips such as gap strips 7, 8 and 9 arranged in the gap itself and forming with their upper edges the roadway surface across the gap. In order to make the construction water-tight, and also in order to support the plates with respect to each other, expansion members 10 of elastic material are arranged between adjacent gap strips and between an edge plate and the respective gap strip adjacent to the respective edge plate. The members 10, the plates 5 and 6, and the strips 7, 8, 9 may extend longitudinally through the entire length of the gap or over part of the length of the gap depending on the type of construction.

To support the gap strips 7, 8 and 9, legs or rods 11 are secured at their upper portions to said plates and strips. The lower ends of the rods associated with an adjacent plate or strip are connected to each other so that each plate or strip is connected through the respective rods to the next adjacent plate or strip. The rods associated with the strips 7 and 9 and inclined towards the middle of the gap are connected to the rods associated with the strip 8. The rods which are inclined in an outward direction are connected to the rods associated with the edge plates 5 and 6. The forces induced in the rods 11 when the gap is subjected to a load are thus transmitted via the two outer rods 11*a* and 11*b* to the edges of the gap. It will be understood that to support the strips in the longitudinal direction of the gap, several of the rod assemblies shown in FIG. 1 are provided. The upper ends of the rods are inserted in holes in the strips and plates and retained in said holes by pins 12. The same manner of attachment may be used for connecting the lower ends of the rods. For this purpose connecting bars 13, shown in section, are provided with holes 14 to receive the rods. The rods are retained in the holes by means of pins 15. The bars 13 could be cut from continuous longitudinal stock, substantially to the same length as the plates and strips. However, the members 13 could equally well be made shorter, so that for example only two or three rod interconnections are provided on each member. Finally the bars 13 could also be in the form of short blocks, each of which is only designed to secure and interconnect two rods 11. The ends of the rods in the plates and in the bars 13 are preferably retained in an encased manner. The less the freedom of movement that is available to the ends of the rods, the less play there is in the whole assembly and accordingly the more effectively are the resilient forces in the rods utilized. However, it would also be possible to provide pivotal connections whereby an overall elastic degree of freedom of movement would result.

Figure 2:
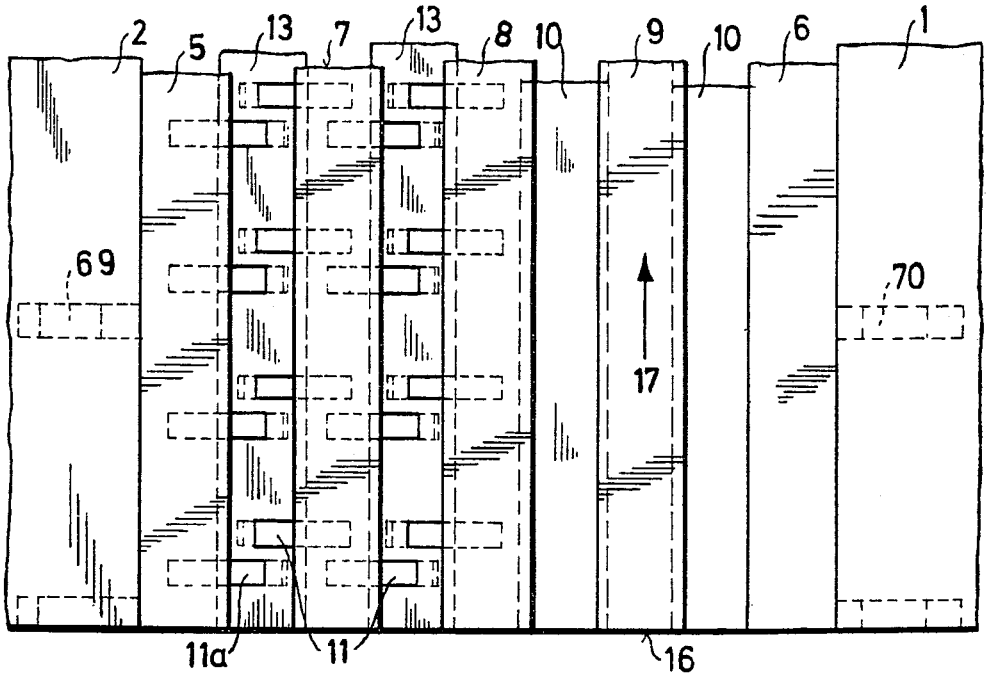
FIG. 2 is a plan view of the device of FIG. 1.

FIG. 2 shows a plan view of FIG. 1. Between the edges 1 and 2 of the gap to which the edge plates 5 and 6 are connected, the gap strips 7, 8 and 9 are arranged to be movable transversely with respect to the gap. The bars 13 and the strips and plates extend from the edge 16 of the assembly in the longitudinal direction of the gap indicated by the arrow 17. As mentioned, the length of the plates and strips as well as of the bars 13 extending from the edge 16 may be chosen as desired. In the left hand half of FIG. 2 the expansion members 10 are omitted so that one may see the bars 13 and the rods 11. The edge plates 5 and 6 are secured in the concrete of the roadway foundation 4 by means of anchors 69 and 70.

Figure 3:
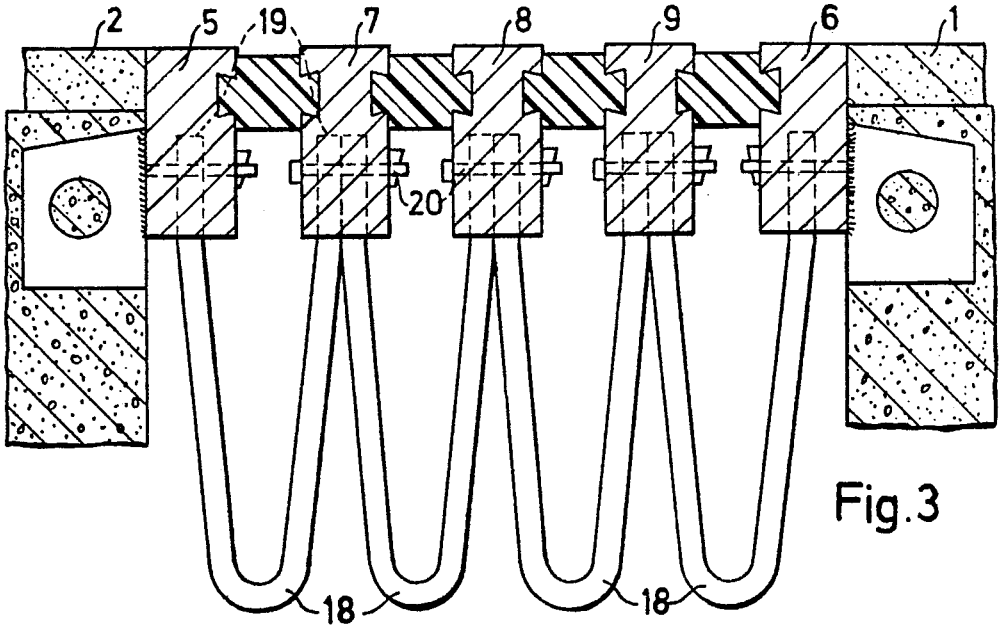
FIG. 3 is a section through the gap illustrating a modified embodiment with a support made of rods bent to a U-shape.
Figure 4:
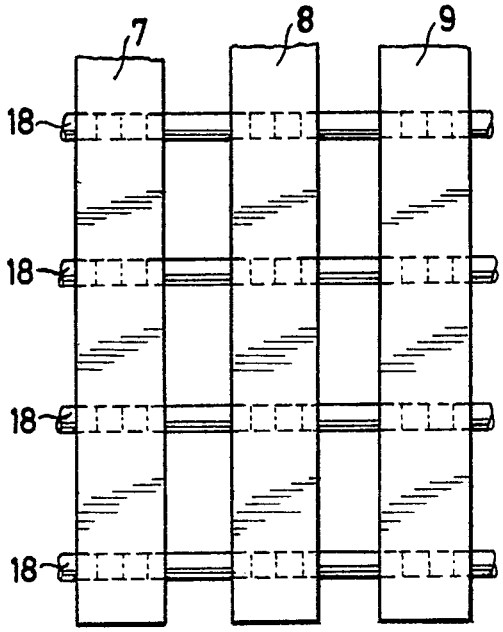
FIG. 4 is a plan view of the device of FIG. 3.

FIGS. 3 and 4 illustrate a device in section and in a plan view, corresponding to its basic construction substantially to the embodiment of FIGS. 1 and 2. Again the edge plates 5 and 6 are connected to the edges 1 and 2 of the gap. The gap strips 7, 8 and 9 are connected to each other and to the edge plates by means of the rods 18 bent to a hairpin shape. Thus, each rod connects two adjacent gap strips or a gap strip and an edge plate. The edge plates 5 and 6 are connected to the edges of the gap for example by welding the plates to the anchors 69, 70. The connecting elements are solely the rods 18 which as viewed in the longitudinal direction of the gap, that is perpendicular to the plane of the drawing, are arranged one behind another, at predetermined spacings, whereby the total number of rods will depend on the bearing capacity of the overall assembly. The upper ends 19 of the rods are again received in holes in the plates and retained by pins 20. The rods 18 are preloaded into position, whereby the rods effect a restoring or biasing action on the movable gap strips 7, 8 and 9, so that these strips are always held in a central position. This arrangement has the advantage that both the vertical loads and also the horizontal braking or accelerating forces may be taken up by the rods.

Figure 5:
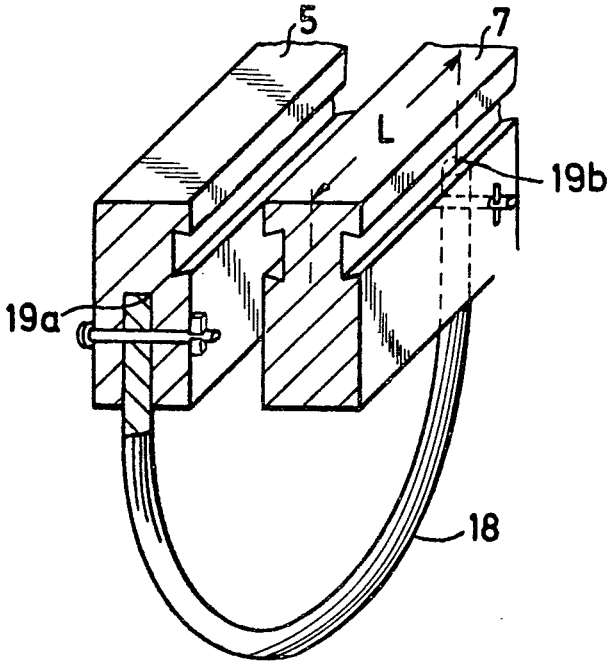
FIG. 5 shows in perspective a modification of the device shown in FIGS. 3 and 4.

FIG. 4 shows a plan view of the device of FIG. 3 whereby only the strips 7, 8 and 9 with their rods 18 are shown. An even better utilization of the elastic forces in the rods 18 can be achieved by arranging these rods as illustrated in FIG. 5 whereby the ends 19*a* and 19*b* of a rod, as viewed in the direction of the length of the gap are connected to the gap strips one behind the other so that the rods 18 as viewed in a plan view extend in directions inclined to the transverse direction of the gap. In FIG. 5 the end 19*b* is displaced by the distance L with respect to the end 19*a* of the rod 18. As a result of such displacement and in response to a change in the spacing between the gap strips the rods 18 will be loaded both with bending and torsion forces.

Figure 6:
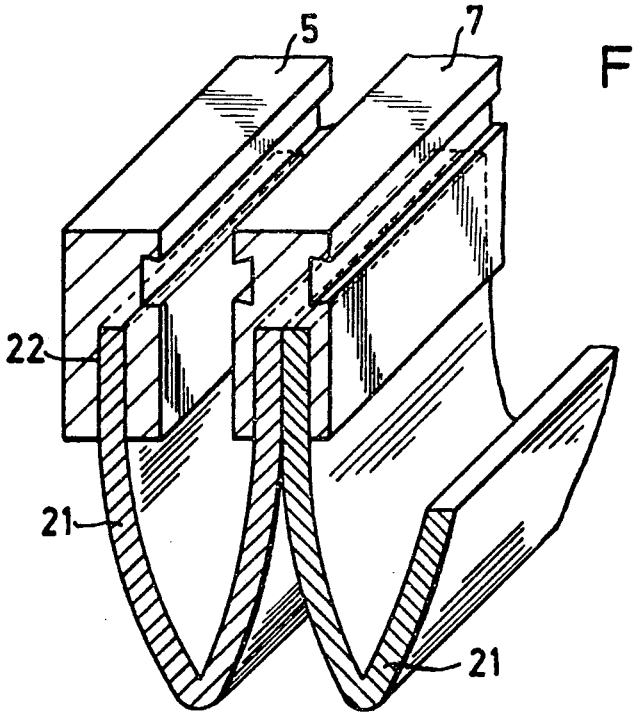
FIG. 6 shows a perspective view of a portion of a further embodiment with a support made of V-or trough-shaped plates.

In view of the foregoing it will be appreciated that the rod combinations form elastic support means for the gap strips. These support means may also be made of connecting members formed from sheet material. Such connecting members formed of sheet material could extend over the whole length of the expansion gap or of the gap strips and in parallel to the latter. FIG. 6 shows such a support made of sheet material formed into channels 21. Adjacent plates 5 or strip 7 are connected together by such a channel. The edges of the channels are secured in longitudinally extending slots 22 in the undersides of the plates and strips. In another possible way of attachment, not illustrated, the channels could be attached laterally to the outer faces of the plates and strips. As the edge plates, the strips, the rods and the channels in the device according to the invention are preferably made of steel, hence welding offers itself as a means of attachment. Preferably, the elements should be of sufficient size so that the resulting connections are of the encased type rather than of a point type.

FIG. 7 illustrates an embodiment similar to the elastic support shown in FIG. 6. However, the channels are formed of a continuous undulating piece 23 to the upper ridges of which the gap strips 7, 8 and 9 are secured for example by weldments.

Figure 8:
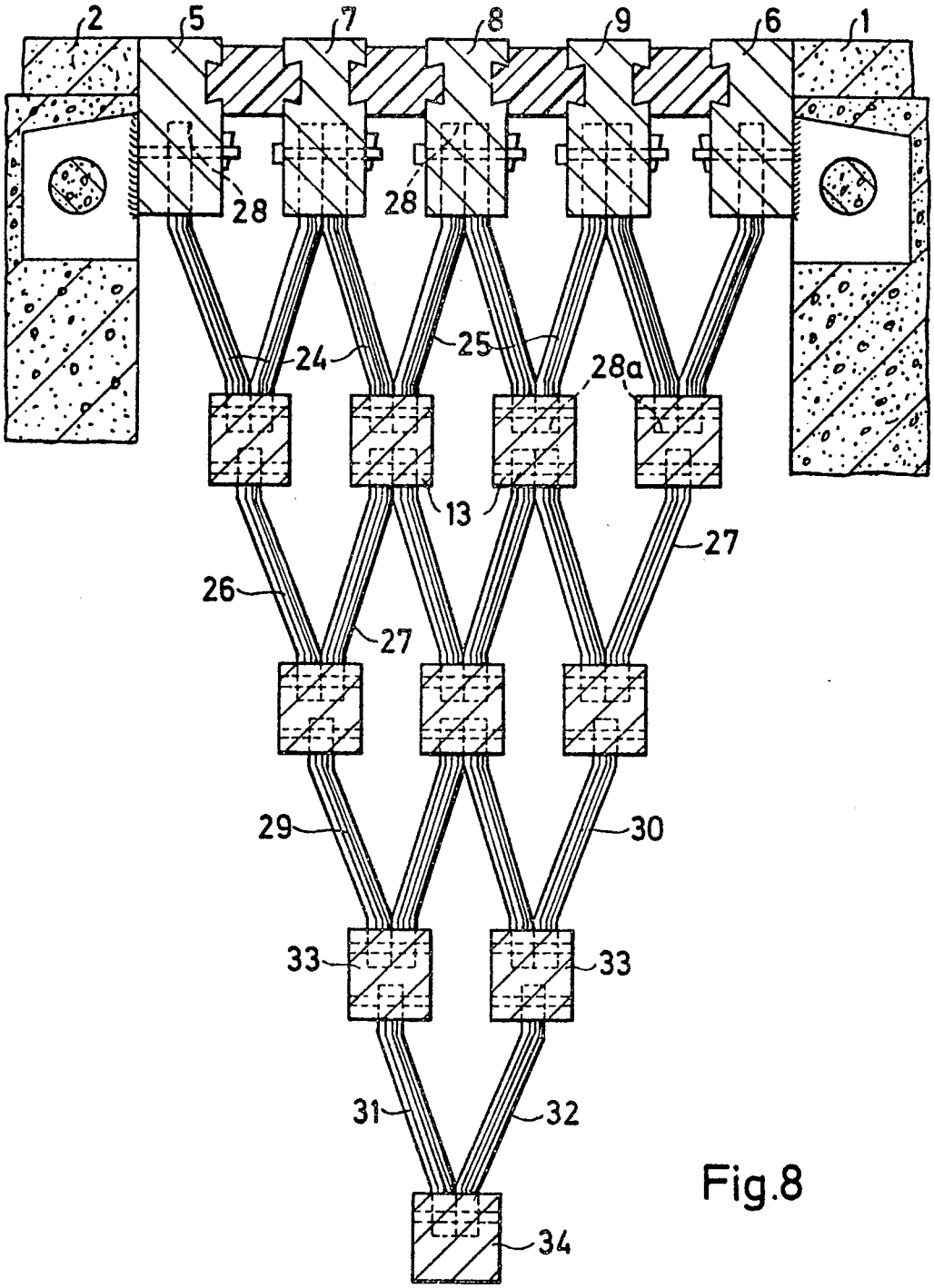
FIG. 8 is a section through a device with a support made of rods interconnected to form a plurality of connected Y-configurations.

FIG. 8 shows an embodiment employing pairs of rods 24 and 25, 26 and 27 combined to form fork-like shapes. The upper ends 28 of the rods 24 and 25 are secured to the lower faces of the gap strips 5, 7 and 8 and so on. The lower ends 28*a* of the rods 24, 25 are connected to the bars 13 which extend in the direction of the length of the gap and serve for connecting several assemblies of pairs of rods arranged one behind the other in the direction of the length of the gap. Only one assembly is shown in FIG. 8. In order to increase the load capacity of the elastic support made up of the rods 24 and 25, it is possible to arrange the rods in several levels one above another. In FIG. 8 further rods 26, 27 are secured to the undersides of the bars 13, these further rods again forming a level or rods extending over the whole width of the gap. Below this level there is a still further level of rods 29 and 30. A final level comprising rods 31 and 32 is arranged between bars 33 and 34. As a whole the rods form a structure with bars 13, 33 34 provided at each nodal point. The structure shown in FIG. 8 is of downwardly tapering shape from level to level, so that it produces a completely closed assembly. The number of levels will be chosen according to the load required capacity.

FIG. 9 shows a portion of a device the elastic support of which resembles that of FIG. 8. However, instead of the rods 24 and 25 the plates 5 and the gap strips 7 and so on are supported by leg members 35 and 36 of sheet metal. The lower ends of these continuous sheet metal legs are again interconnected by the bars 13 and clamped in them.

FIG. 10 shows a portion of a device with an elastic support structure which is formed by flat leg members 37 and 38. The leg members 37 and 38 could be independent of each other. However, they could also be formed by tongues shaped in a single piece of sheet metal that is continuous in the region of the edge 39, the tongues 37 and 38 being cut from it and bent in different lateral directions alternately along the length of the gap, so that the tongues 37 are connected in an encased manner to the bars 40 or 41 arranged on the left side and below the strip 7 or 8 and the tongues 38 are connected similarly to the bar 41 arranged on the right side and below the strip 7. The upper ends of the tongues 37 and 38 are inserted into downwardly open slots 42 in the gap strips 7, 8 and so on and are secured therein, for example, by means of screws 43. The construction illustrated in FIG. 10 is suitable or particularly heavy traffic loads.

FIG. 11 shows a portion of a device with an elastic support made up of three-dimensionally bent rods 44, 44*a*. The rods connect the bars 45 and 45*a* alternately to the edge plate 5 and to the adjacent gap strips 7 and 8. The rods may be connected to the plates, bars and strips, for example, by weldments at the upper and lower bending points 46 and 47.

In the bars 45 and 45*a* there are provided transverse slots 48 for better supporting the lower bend of the respective rod. The edge plates 5 and the gap strips 7 have inclined lateral surfaces 49, 50 respectively to achieve exact engagement of the rods in the region of the bends. The upper bend of the adjacent rod is secured to the inclined, lateral surface 49 of the plate 5 shown in FIG. 11 whereby the plate 5 is connected via the bar 45 to the adjacent strip 7 and so on. The rods secured to each gap strip and leading to different strips are mutually displaced with their upper bend points secured to the plates and strips so that a closely interengaging three dimensional network of rods is produced between all the plates, strips and rods.

FIGS. 12 to 19 illustrate further examples for connecting the lower ends of the rods in devices with gap strips supported on a plurality of rods. In FIG. 12 the rods 53 for the gap strip 7 are connected to the rods 52 of the gap strip 8 through a torsion member 51. The torsion member, which is shown in plan view in FIG. 12 and in longitudinal section in FIG. 13 is arranged below the strips 7 and 8 and comprises a rubber body 59 with a rigid cover 55, for example, made of metal. The cover 55 is extended at one face of the torsion member 51 to form a wall 55*a* to which the rod 52 is welded by its angled end 57. The angled end 56 of the other rod 53 is secured against rotation in a bushing 54 which is inserted axially into the rubber body. The bushing 54 and the end 56 of the rod 53 preferably have an angular cross sectional profile, for example rectangular, so that the end 56 is positively held in the bushing 53. The rubber body is secured, for example by an adhesive to the bushing 53 and to the cover 55 in a positive manner by keying or by a compressing force.

A modified torsion member is shown in section in FIG. 14. Here the angled ends 56 and 57 of the rods 53 and 52 are rigidly connected to end plates 58 (preferably of steel) for example, by welding. The end plates 58 are in their turn vulcanized to a rubber body 59. FIG. 15 and 16 illustrate a further embodiment of a torsion member 60. It connects the lower ends of rods 61 and 62 which are connected to the gap strips 7 and 8 in the manner shown in FIG. 1. The rods 61 which are connected to the strip 8 have angled lower ends 63 which are secured against rotation in the rubber body 65 of the torsion member 60. Preferably, adjacent rods 61 may be connected together through their ends 63 to form a U-shaped connecting link. FIG. 17 shows a section through such a connection. The ends 63 have a square cross section and are keyed into the inside of a metal bushing 64 which is rigidly secured to the rubber body 65 of the torsion member.

The rod 62 joined to the gap strip 7 is connected to the cover 55 of the torsion member 60 in the middle between the rods 61. The rod 62 has a fork-like lower end 66 which is welded to the cover 55.

Starting with the gap strips 7 and 8 placed together, the rods 61 as viewed in the direction of the length of the gap, apply a counter-clockwise bending moment and the rod 62 applies a clockwise moment to the torsion member 60 so that when the gap strips 7 and 8 move toward each other the torsion member is subjected to increasing loads whereby said movement of the plates toward each other is opposed by an increasing elastic resistance.

In FIG. 19 a splined shaft 71 is used as the torsion member. The rods 72 and 73 which are connected to the gap strips 7 and 8 have each at their lower end a ring 74 provided with internal teeth meshing with the splines of the shaft. When the gap strips move, torsional forces are applied to the spline shaft 71 via the rods 72 and 73 and lead to twisting of the shaft region between the rings 74. When a splined shaft is used torsional forces of any desired magnitude may be handled, depending on the dimension and material of the shaft.

Figure 26:
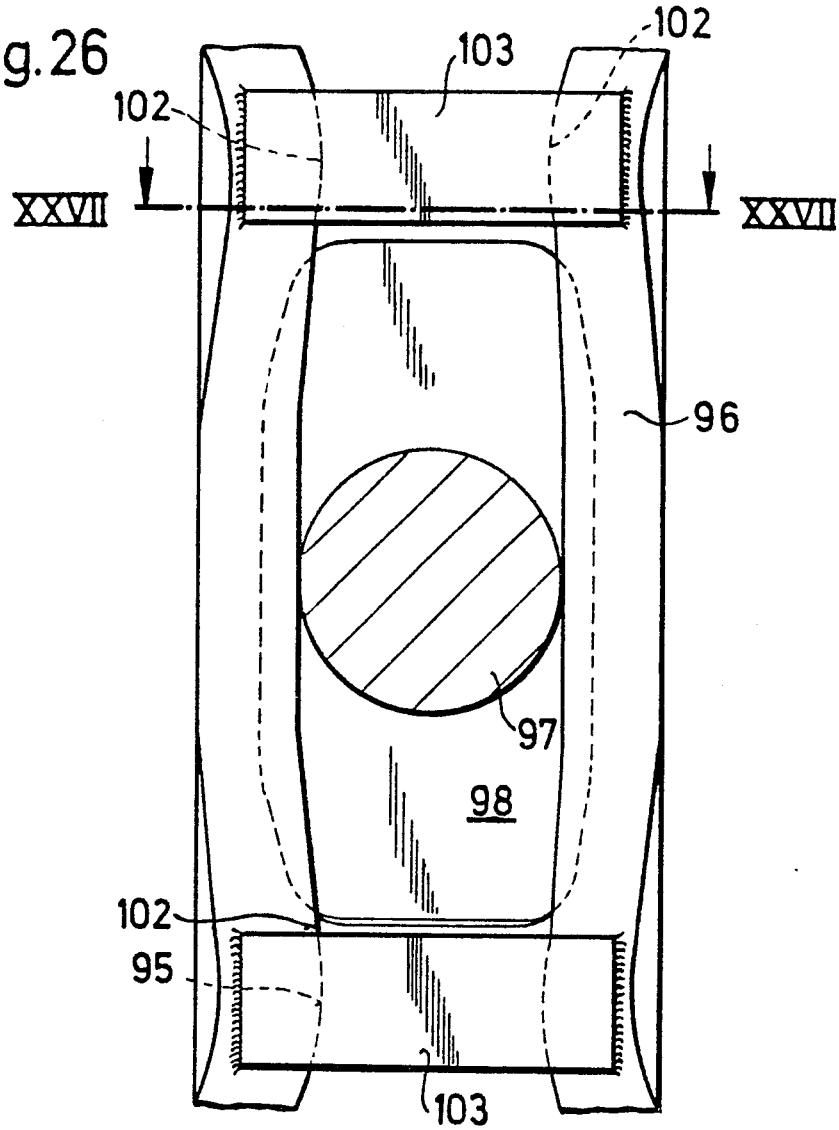

FIGS. 20 and 26 illustrate various modifications for connecting the rods to the plates and gap strips. In FIG. 20 the rod 75 is wound around a core 76 and embraced by the plate 77 which is thus connected to the rod. The plate has an internal profile 78 corresponding to the external shape of the wound rod 75. The jaws 79 of the plate profile can be bent inwardly somewhat towards the rod, so that a secure attachment of the rod is achieved.

FIG. 21 shows a gap strip 80 with projections 81 on its underside. The rods 82 to be connected to the plate are tubular or have at least a tubular end to fit over the projections to which they are for example welded to hold them in place.

FIG. 22 shows a gap strip 83 with short tubular sleeves 84 attached to its underside. The rods 85 to be connected to the plate are inserted in the sleeves and retained, for example, by cotter pins 86.

Figure 23:
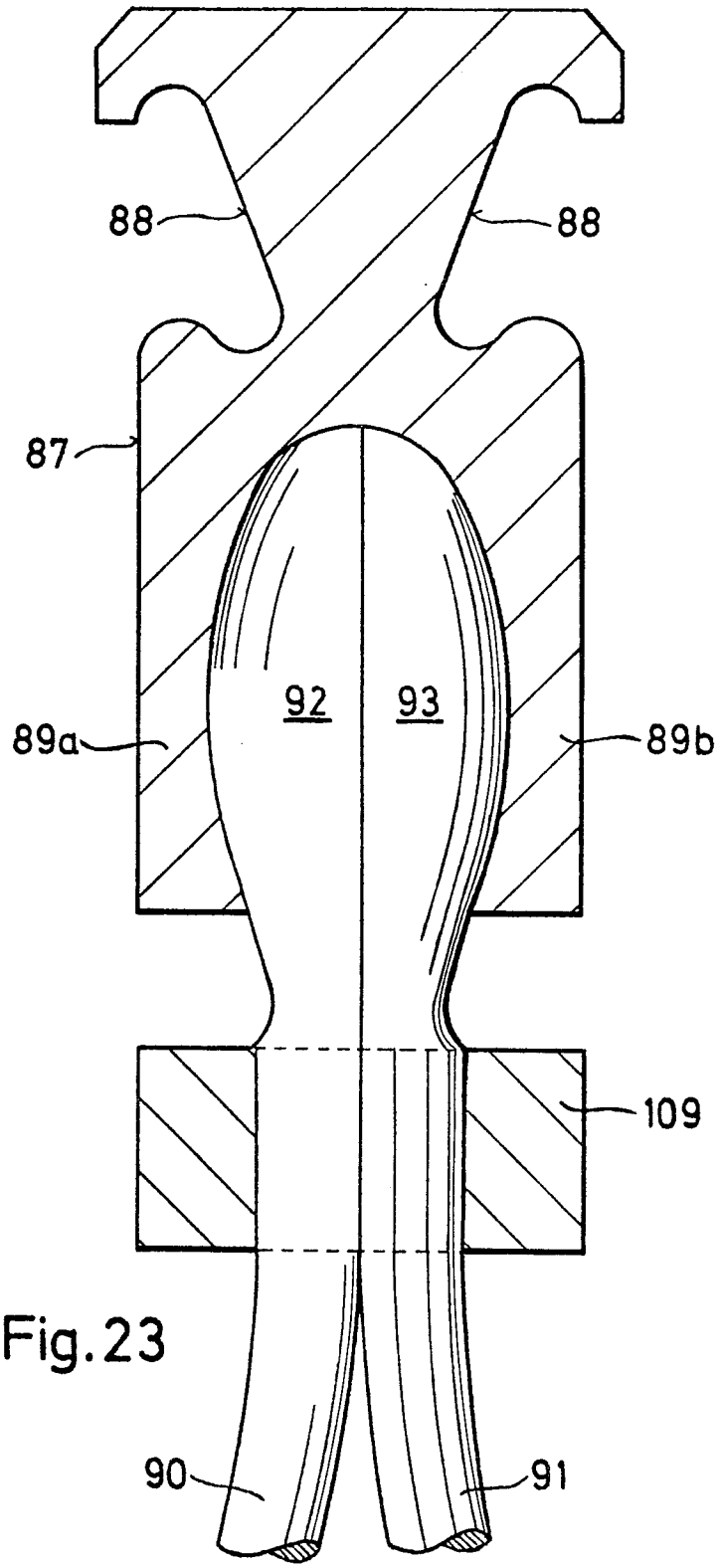

FIG. 23 shows a gap strip 87 with recesses 88 for connecting the expansion members. In its lower region the strip 87 is split to form two jaws 89. When these jaws are spread apart, the thickened ends 92 and 93 of rods 90 and 91 may be forced between the jaws, whereupon the jaws are pressed back together to the position shown in FIG. 23. The jaws 89 could, however, also initially have the positions shown in FIG. 23. In this case the ends of the rods could be inserted at the end of the strip. To secure the ends of the rods after they have been inserted and adjusted to their correct positions, the jaws are deformed inwardly in front of and behind the attachment points by cold deformation, so that the ends of the rods are partially enclosed. At their mutually facing sides the ends 92 and 93 of the rods are flattened so that they have surface contact with each other. Somewhat spaced from the strip 87 the rods 90 and 91 are held together by a squeezed on clamping ring 109 so that the attachment point in the region of the strip 87 is free from the action of forces produced by the movements of the strips.

Figure 24:
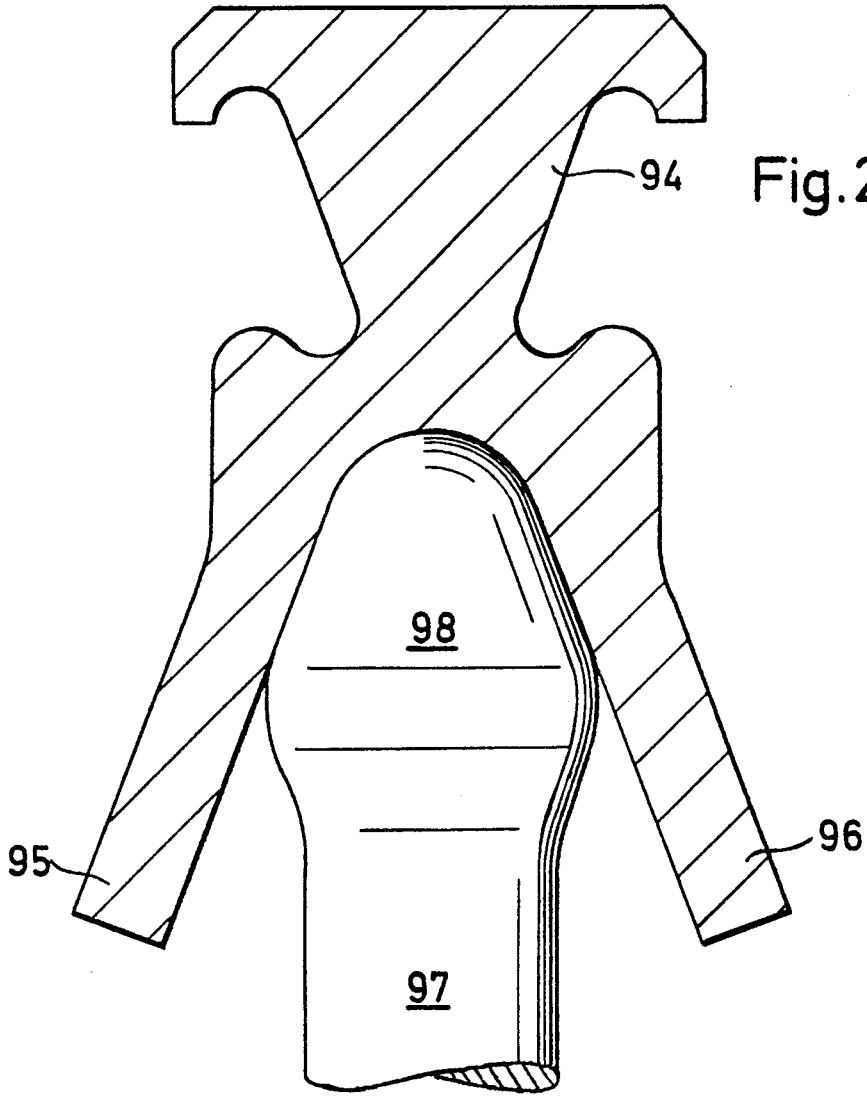
Figure 25:
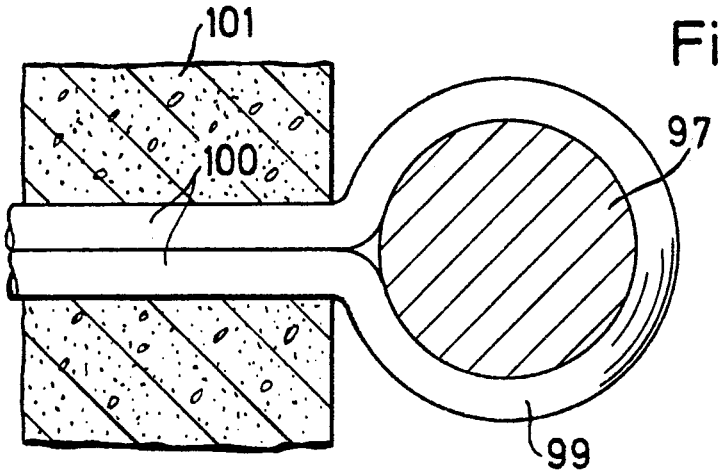

FIG. 24 shows a strip 94 also provided with jaws 95, 96 in its lower region. The shape of the illustrated strip with the slightly spread jaws 95, 96 corresponds to the basic shape of the continuously cast or extruded profile of the strips. For attaching a rod 97 with its thickened end 98 the jaws 95 and 96 are bent inwardly to enclose the thickened portion 98 also from below. The jaws 95 and 96 could in addition be bent inwardly in front of and behind the thickened end 98, as viewed in a direction perpendicular to the plane of the drawing.

Where the rod 97 is to be connected to an edge plate the rod may be enclosed as shown in FIG. 25 in a ring-shaped anchor 99 which is connected to an anchor plate 100 embedded in the concrete of the edge 101 of the gap.

Figure 27:
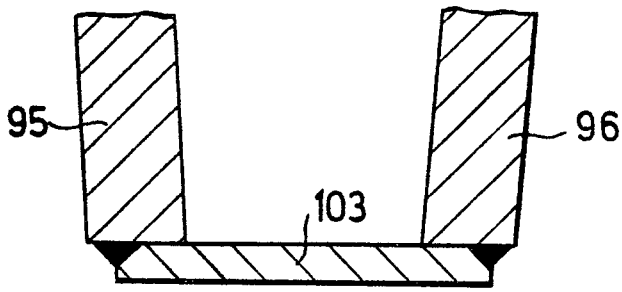

In FIG. 26 the arrangement of FIG. 24 is illustrated as seen from below. The jaws 95 and 96 are deformed inwardly in the regions adjacent to the rod 97 on both sides of the rod. The thickened end 98 of the rod is extended in the direction of the longitudinal axis of the plate or strip in order to connect the rod in a manner which secures it against rotation. Preferably, straps 103 bridge the jaws 95 and 96 at 102 on both sides adjacent to the attachment point. The straps are welded to the undersides of the jaws 95 and 96 to hold them together as best seen in FIG. 27.

FIGS. 28 and 29 illustrate two embodiments of a device according to the invention, suitable for bridging very wide gaps. In these embodiments additional supporting means are provided, so that in wide gaps sagging of the intermediate gap strips is prevented which otherwise could occur due to the chain of springs formed by the sections of the support structure. Moreover such additional supporting means may be used in combination with sections of the gap bridging means made of rods and strips of lighter and less stiff construction than would otherwise be possible.

In FIG. 28 which is a view similar to FIG. 1, the intermediate rods **11*c* of the support, interconnecting the strips 8 and 9, are supported on cushion bars 13*a* interconnecting the lower ends of the rods 11*c* on a ledge 110 of the gap edge 1, projecting into the gap. The cushion bar 13*a* includes a plate 116 connecting the ends of the rods 11*c* and resting on a rubber spring 115 which in turn rests on a carriage 117. A roller 112 is rotatably mounted in the carriage 117 and rests on the ledge 110. The rubber spring 115 permits the vertical movement of the lower ends of the portions 11*c* when the gap changes but on the other hand it transmits a sufficiently large supporting force to prevent the strips 8 and 9 and the strips 7** adjacent thereto from sagging.

FIG. 29 shows another embodiment in which a large gap has an intermediate gap strip **5*a* forming practically an artificial gap edge which divides the gap into two halves. The gap strip 5*a* rests slidably on a transverse support member 111 projecting from the edge of the gap. The support formed by the sections 11 in each partial gap is carried on the one hand by the plates 5 and 6 secured to the gap edges 1, 2 respectively, and on the other hand by the central gap strip 5a which slides with its supporting surface 119 on the transverse support member 111. A control pinion 114 is rotatably mounted on the lower end of the strip 5a. The pinion cooperates with racks 113 and 118 projecting from the respective edges of the gap. When there is relative displacement between the edges 1 and 2 of the gap the strip 5a is displaced by the racks 113, 118 and by the control pinion 114 so that it remains centrally between the edges 1 and 2. In this embodiment as in some of the other embodiments, the lower ends of the rods 11** may be simply welded together.

The structures shown in FIGS. 28 and 29 have an increased load capacity relative to vertical loads so that even large gaps can be bridged by means of the device according to the invention in a rather economical manner.

In view of the foregoing it will be appreciated that depending on the length of the expansion gap it may be advantageous to provide several rows of legs in the longitudinal direction of the gap arranged one behind the other and next to each other transverse to the gap. However, it is possible to use single rows of legs which are as long as the gap.

In a preferred embodiment of the invention the legs are connected together as a framework whereby the leg ends are combined at the nodes. The framework may be constructed to taper downwardly in its overall profile as shown in FIG. 11. The nodes can be formed at or by the strips and/or by further strips or bars arranged parallel to and below the first mentioned strips. The strips could each contain two or more nodes.

This embodiment allows using shorter and thereby kink-resistant but at the same time elastic rods for the legs. The connection of the rods at the nodes is advantageously arranged so that all movements take place solely by elastic deformation, whereby no play is necessary between connected legs.

The legs may be resilient at least in one direction transverse to the gap, whereby at least one leg end is rigidly or resiliently clamped or connected. Preferably the legs are slanted so as to be preloaded or biased towards an intermediate position in the gap. This bias of the legs provides a spring force which simultaneously tends to hold the strips against displacement by braking or acceleration forces imparted by the vehicles that pass over the device in the gap.

According to a preferred feature of the invention the legs are made of flat or profiled or hollow sectional stock for example divided into portions arranged one behind another, with their upper and lower ends bent over alternately toward one or the other edge of the gap. The profiled stock may, for instance, be corrugated material. The profiled material may have preferably a U-or V-shaped cross section. However, as described, the legs may also be made of standard rod stock.

Where the legs are made from rod stock the individual legs may be combined into supporting structures having various configurations, one being shown, for example, in FIG. 11. The ends of the individual rod legs may be connected in various manners, for example, one end may be clamped or encased and the other end can then be connected in a different manner, for example, pivotally. In any event all the spaces between the strips will be bridged by said rods. In addition to bending the rods into the described U-or V-shaped the two ends of such shapes may be held in mutually displaced positions as viewed in the direction of the length of the gap. The ends of the rods are then subjected in addition to bending to torsion at each movement of the plates.

With regard to the formation of a rod having a plurality of loops as shown in FIG. 11 it should be noted that the loops could extend in a plane transverse to the gap or in the longitudinal direction of the gap. With loops extending in the longitudinal direction the upper bends could be connected alternately to one and the other of two adjacent strips or edge plates. The lower bends of the loops could be secured to a strip which is common to the lower bends in the same or in different rod loops.

According to a further feature of the invention substantially straight individual rods are provided and have their upper ends secured in the plates and lower ends interconnected through torsion members to receive bending moments with bending vectors extending substantially parallel to the longitudinal direction of the gap. In this embodiment, the rods can be almost rigid. Two, three or more of these rods arranged one behind the other in a longitudinal direction could then engage in the same torsion member. The torsion members could be made of elastic material such as rubber or similar elastomeric bodies which have terminating portions of rigid material for connecting to the rods, and at opposite ends in the longitudinal direction of the gap the elastic bodies could engage two respective rods connected to different strips as shown in FIG. 12 for example or the opposite ends of an elastic body could be connected to two rods which in turn are connected to one strip and a third rod could be connected to a different strip and secured substantially to the middle of the elastic body as shown in FIG. 16. The torsion members could also be formed as splined shafts, onto which the ends of the rods, provided with appropriate internal teeth, are forced as shown in FIG. 19.

Where the upper rod ends are secured to intermediate strips, that is to say strips other than the two outer edge plates, two rod ends can be received side-by-side between the jaws, each rod occupying half the space between the jaws as shown in FIG. 23. In this way the rods which provide the connection to the adjacent strips on both sides can be secured in a single deformation process. In order not to overload the attachment points and to oppose any tendency for the rods to be forced out of their attachment points the two rods may be squeezed together below the jaws by a clamping ring.

In the above versions of the invention the strips including the edge plates may be extruded sections on which continuous jaws are formed, which are folded over by subsequent cold deformation in the region of each rod attachment point. In order to prevent the turning of the rods at their attachment points, the rods may have a broadened shape in the longitudinal direction of the plates. In order to prevent opening of the jaws that are folded around the ends of the rods the attachment points can be secured on both sides by straps holding the jaws together.

Where gaps of large widths are to be bridged with the device according to the invention, it may be helpful to movably support the support structure carrying the strips not only at the edges but additionally at one or more points, whereby sagging is avoided. In order to achieve this one or more of the legs may be supported at its lower connecting end on a component of an edge of the gap, extending into the gap at a suitable level which is variable, preferably elastically, and displaceable in the direction of the longitudinal axis of traffic movement. The elastic support in a vertical direction is necessary so that the lower end of the supported section can move vertically on alteration of the gap width so that the roadway strips are not forced out of the road surface. The elastic support can be achieved with the aid of a rubber spring or another spring, or if necessary even hydraulically. However, one or more of the strips could also be supported directly on a component of an edge of the gap extending into the gap. In this case it is of advantage to control the strip or strips with regard to its position between the edges of the gap, i.e., to couple it to the edges of the gap in a manner such that the relative position of the strips to each other and to the gap is maintained.

Elastically movable portions of the support structure could, within the scope of the invention, extend as far in the direction of the depth of the gap and as the gap shape permits. A construction of the support sections going particularly extensively downward, for example, in the form of very long rods is necessary for example when wide gaps which require very heavy section rods are to be bridged. The desired elasticity can then be maintained by correspondingly increased rod length. Within the scope of the invention it is not absolutely necessary to connect adjacent strips by abutting legs. If necessary, also adjacent strips need not be connected, for example, every second strip could be connected by two directly cooperating elastic legs.

Incidentally, FIG. 30 illustrates an embodiment wherein the lower end of the first legs 11*a* is connected to a downwardly extended edge plate 5'. Contrary thereto, in FIG. 1 the upper end of the first leg 11*a* is connected to the edge plate 5.

Although the invention has been described with reference to specific example embodiments, it is to be understood, that it is intended to cover all modifications and equivalents within the scope of the appended claims.

What is claimed is:

1. In an expansion gap sealing device for bridging an expansion gap between edges of structural members, wherein rigid gap strips and elastic strips are alternately arranged to extend in parallel to each other and longitudinally inside the gap, said rigid and elastic strips forming an expansion and sealing assembly which is connected along its outer sides to the edges of the gap, and which is carried by supporting structure means variable in its length across the gap and connected on both sides to the edges of the gap, the improvement wherein said supporting structure means comprises at least two supporting legs each having an upper end and a lower end, first means connecting said upper leg ends to said rigid gap strips so that the legs extend downwardly into the gap, and second holding means to which said lower legs are connected to form an elastically yielding supporting structure.

2. The device according to claim 1, wherein said supporting structure means comprise several levels of legs, and means for interconnecting said several levels of legs with each other, whereby a plurality of leg sections are arranged in side-by-side relationship transverse to the gap.

3. The device according to claim 2, wherein each higher level of legs is wider than the level therebelow so that the supporting structure tapers downwardly.

4. The device according to claim 1, wherein said legs are formed from longitudinal flat stock.

5. The device according to claim 4, wherein said flat stock is cut into sections and wherein the longitudinal edges of the sections are bent out of the plane of a section in opposite directions.

6. The device according to claim 1, wherein said legs are formed as channel legs from channelled sectional stock.

7. The device according to claim 6, wherein said channel legs are arranged side by side, and wherein upper edges of the channel legs are connected to said strips.

8. The device according to claim 6, wherein said channel legs face downwardly with the open face of the respective channel, and wherein ridges of the channel legs are connected to said strips.

9. The device according to claim 6, wherein said channel legs face upwardly with the open face of the respective channel, and wherein the edges of adjacent channel legs are connected to each other and to said strips.

10. The device according to claim 1, wherein said legs are formed of corrugated material having upper and lower ridges.

11. The device according to claim 10, wherein said upper ridges are connected to said strips.

12. The device according to claim 10, wherein said supporting structure comprises connecting bars, said lower ridges being connected to said bars.

13. The device according to claim 1, wherein said legs are formed of substantially straight rods, connected at their upper ends to said strips, said connecting means comprising one or more torsion members to which the lower ends of said rods are connected, whereby the torsion members receive bending moments.

14. The device according to claim 13, wherein said torsion members are made of elastomeric material and comprise means for connecting said rods to the torsion members.

15. The device according to claim 13, wherein three rods are connected to each torsion member, two of said three rods being connected to strip means extending on one side of the torsion member and the third rod being connected to gap strip means extending on the other side of the torsion member, said third rod being connected substantially to the middle of said torsion member.

16. The device according to claim 13, wherein said torsion members are splined shafts, and wherein said rods comprise ring ends with grooves therein which fit onto said splined shafts.

17. The device according to claim 1, wherein said connecting means and said holding means comprise welding seams.

18. The device according to claim 1, wherein said legs have tubular ends and wherein said connecting means and said holding means fit into engagement with said tubular ends.

19. The device according to claim 1, wherein the ends of the legs are thickened, and wherein at least said connecting means comprise spread jaws for receiving said thickened ends, whereby the space between the jaws has a shape matching the ends of the legs.

20. The device according to claim 19, wherein two mutually engaging leg ends each of which fills half the space between the jaws, are received between the jaws.

21. The device according to claim 20, wherein said connecting means comprise a ring member for clamping together said two leg ends below the jaws, whereby said ring is out of contact with the jaws.

22. The device according to claim 19, wherein said connecting means comprise core means, wherein the upper end of said legs is bent around said core means, and wherein the bent upper end is received between said spread jaws of the strip means.

23. The device according to claim 1, wherein the legs are rods, the upper ends of which have a dimension which is wider in the direction of the length of the gap than in the direction perpendicular thereto, whereby the locking between the strips and the legs is facilitated.

24. The device according to claim 1, further comprising guide means for said supporting structure, and means for movably supporting said guide means in said gap.

25. The device according to claim 24, wherein said guide means include an elastic cushion and a carriage for said cushion as well as roller means in said carriage, said supporting structure resting on said cushion, whereby a yielding movement substantially vertically up and down is permitted by the cushion.

26. The device according to claim 24, wherein said carriage is directly connected to one of said strips.

27. The device according to claim 1, wherein said upper leg ends are connected to said expansion and sealing assembly, whereby the legs adjacent to said structural members are also connected with their upper ends to said adjacent structural members and wherein said lower ends of said legs are connected to each other in pairs.

28. The device according to claim 1, wherein said upper leg ends are connected to said expansion and sealing assembly in pairs, and wherein the legs adjacent to said structural members are connected with their lower ends to said adjacent structural members.

29. The device according to claim 1, wherein said legs extend at least at their upper ends perpendicularly to the horizontal and downwardly into the gap.

30. The device according to claim 1, wherein said legs extend at an angle relative to the horizontal and downwardly into the gap so that the pairs of legs diverge downwardly.

31. The device according to claim 1, wherein said connecting means are elastically deformable.

* * * * *

UNITED STATES PATENT OFFICE

CERTIFICATE OF CORRECTION

Patent No. 4,050,207 Dated September 27, 1977

Inventor(s) Silvio Bertschmann et al

It is certified that error appears in the above-identified patent and that said Letters Patent are hereby corrected as shown below:

Column 11, line 41, replace "gap strips" by --gap strip means--; replace "elastic strips" by --elastic strip means--.

line 43, replace "strips" by --strip means--.

line 51, delete "first".

line 52, replace "strips" by --strip means--.

line 53, delete "second"; replace "to which" by --connected to--; after "lower" insert --ends of said-- line 54, delete --are connected--.

line 55, before "." insert --, whereby said supporting legs diverge or converge downwardly toward said holding means as viewed from said connecting means.--.

Column 13, line 21, replace "claim 24" by --claim 25--.

Signed and Sealed this

Fourteenth Day of February 1978

[SEAL]

Attest:

RUTH C. MASON
Attesting Officer

LUTRELLE F. PARKER
Acting Commissioner of Patents and Trademarks